US006234212B1

(12) United States Patent
Griffith

(10) Patent No.: US 6,234,212 B1
(45) Date of Patent: May 22, 2001

(54) PILE LOOP FORMING ASSEMBLY

(75) Inventor: John Dalton Griffith, Sunderland (GB)

(73) Assignee: Griffith Textile Machines, Ltd., Tyne & Wear (GB)

( * ) Notice: Subject to any disclaimer, the term of this patent is extended or adjusted under 35 U.S.C. 154(b) by 0 days.

(21) Appl. No.: 09/579,920

(22) Filed: May 26, 2000

(30) Foreign Application Priority Data

May 28, 1999 (GB) ..... 9912461

(51) Int. Cl.[7] ..... D03D 39/20
(52) U.S. Cl. ..... 139/47
(58) Field of Search ..... 139/47

(56) References Cited

U.S. PATENT DOCUMENTS

| | | | | |
|---|---|---|---|---|
| 1,180,015 | * | 4/1916 | Crossland | 139/47 |
| 2,057,615 | | 10/1936 | Hall Jr. et al. | 139/47 |
| 2,414,064 | * | 1/1947 | Schulz et al. | 139/47 |
| 2,619,990 | * | 12/1952 | Cady | 139/47 |
| 3,450,167 | | 6/1969 | Lygo | 139/47 |

FOREIGN PATENT DOCUMENTS 1059663 8/1965 (GB) .

* cited by examiner

*Primary Examiner*—Andy Falik
(74) *Attorney, Agent, or Firm*—Nikolai, Mersereau & Dietz, P.A.

(57) ABSTRACT

A pile loop forming assembly for looms for reliably transferring yarn from one side of the lance to the other in order for the yarn to be wrapped around the lance to form a loop. The loops may be cut by a blade as the loops advance and ride over the blade edge. The loops are formed by yarns passing through reed fingers wherein lances move the yarn from one side of the reed finger to the other. The lances are attached to a bar, which moves linearly in alternate directions so as to wag the lances to either side of the reed space. A heald moves the yarn up or down to selectively engage or disengage from the lances. A guide formation on a portion of the reed space helps deflect the yarn from one side of the lance to the other. The reed can pivot between a beat-up position and a weft insert position. As the reed moves to the beat-up position it engages the newly formed pile loop on the lance and pushes it to the fell.

12 Claims, 3 Drawing Sheets

PILE LOOP FORMING ASSEMBLY

BACKGROUND OF THE INVENTION

1. Field of the Invention

The present invention relates to a pile loop forming assembly for a loom, a method of forming pile loops on a loom and a loom.

2. Description of the Related Art

In the past lances for forming loops were unreliable. The loop forming yarn was not passed from one side of the lance to the other reliably so that it could be wrapped about a lance to form a loop.

SUMMARY OF THE INVENTION

The loop forming assembly reliably transfers yarn from one side of a lance to the other by moving the lance between a first and second lateral position so that the yarn is positively guided to one side or the other.

According to one aspect of the present invention there is provided a pile loop forming assembly for a loom, the assembly including a reed having a plurality of reed fingers spaced apart to define reed spaces inbetween adjacent pairs of said reed fingers, a plurality of loop forming lances, each lance extending through a respective reed space in order to divide the reed space into first and second longitudinal regions and to divide the first longitudinal region into a first warp yarn accommodating space and a second warp yarn accommodating space, heald means for normally retaining a loop forming warp yarn in said first longitudinal region during shed formation, the heald means being selectively operable to move the loop forming warp yarn from said first longitudinal region to the second longitudinal region so as to move said yarn out of said first or second warp yarn accommodating space, deflection means operatively connected to each lance for laterally deflecting the lance toward one or other of the reed fingers defining the reed space through which the lance passes, such that the lance resides at first and second lateral positions respectively, the lance when at said first lateral position co-operating with said one reed finger to deflect said loop forming yarn into said first warp yarn accommodating space when moving from said second longitudinal space and into said first longitudinal space and when at said second lateral position co-operating with said other reed finger to deflect said loop forming yarn into said second warp yarn accommodating space.

Preferably the lances are pivotally deflected to move between said first and second lateral positions.

Preferably the reed is a beat-up reed for the loom.

According to another aspect of the invention there is provided a loom incorporating a pile loop forming assembly as defined above.

BRIEF DESCRIPTION OF THE DRAWINGS

Various aspects of the present invention are hereinafter described with reference to the accompanying drawings, in which.

DESCRIPTION OF THE PREFERRED EMBODIMENTS

Figure 1:
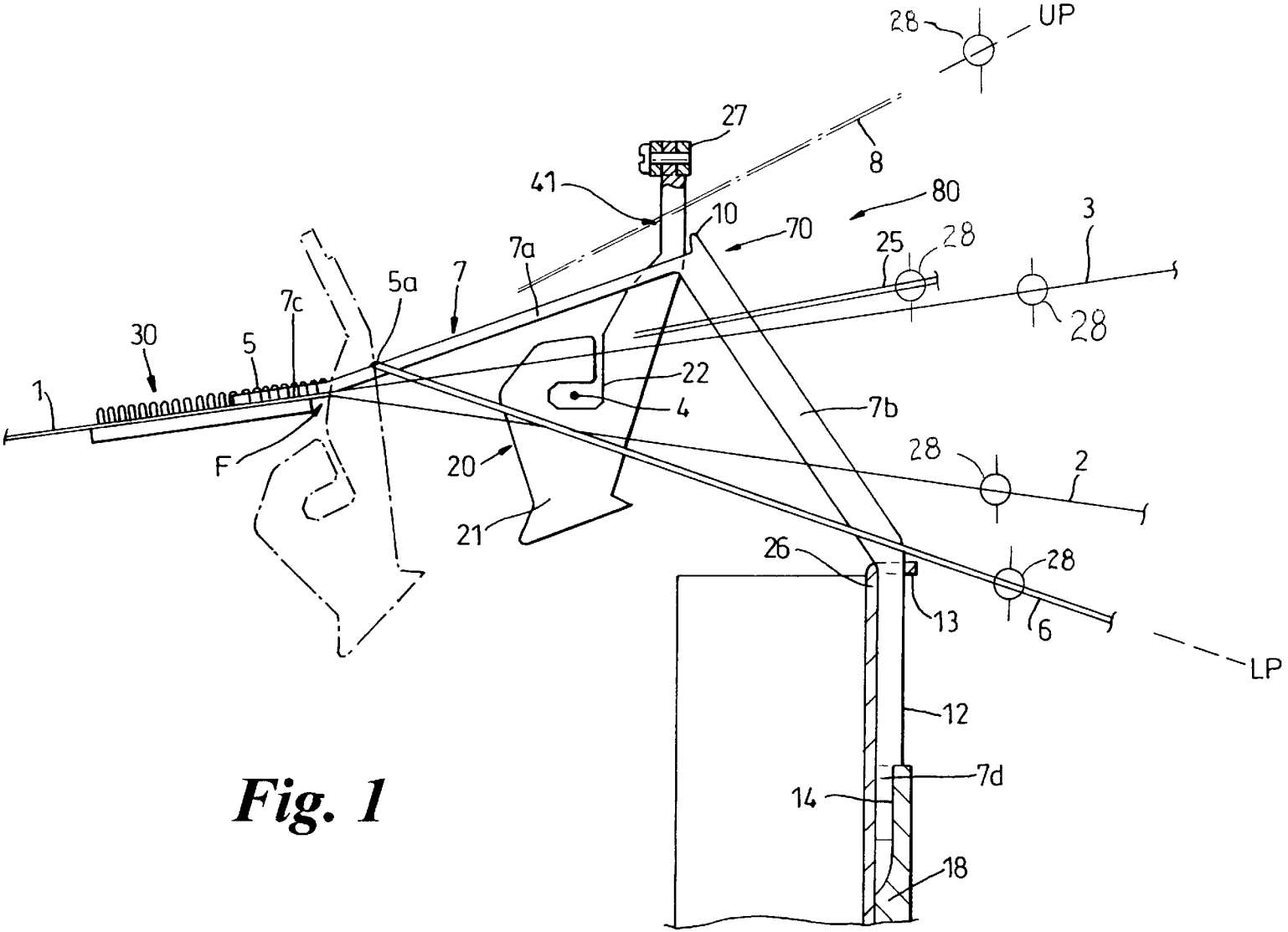
FIG. 1 is a side view of part of a loom incorporating a loop forming assembly according to a first embodiment of the present invention.

In FIG. 1, the loom is arranged to weave carpet 30 having a backing fabric 1 woven from warp yarns 2, 3 and a weft yarn 4. The carpet 30 has pile loops 5 woven into the backing fabric 1; the pile loops 5 being formed, in accordance with the present invention, from pile forming warp yarns 6, 8, 25.

Figure 2:
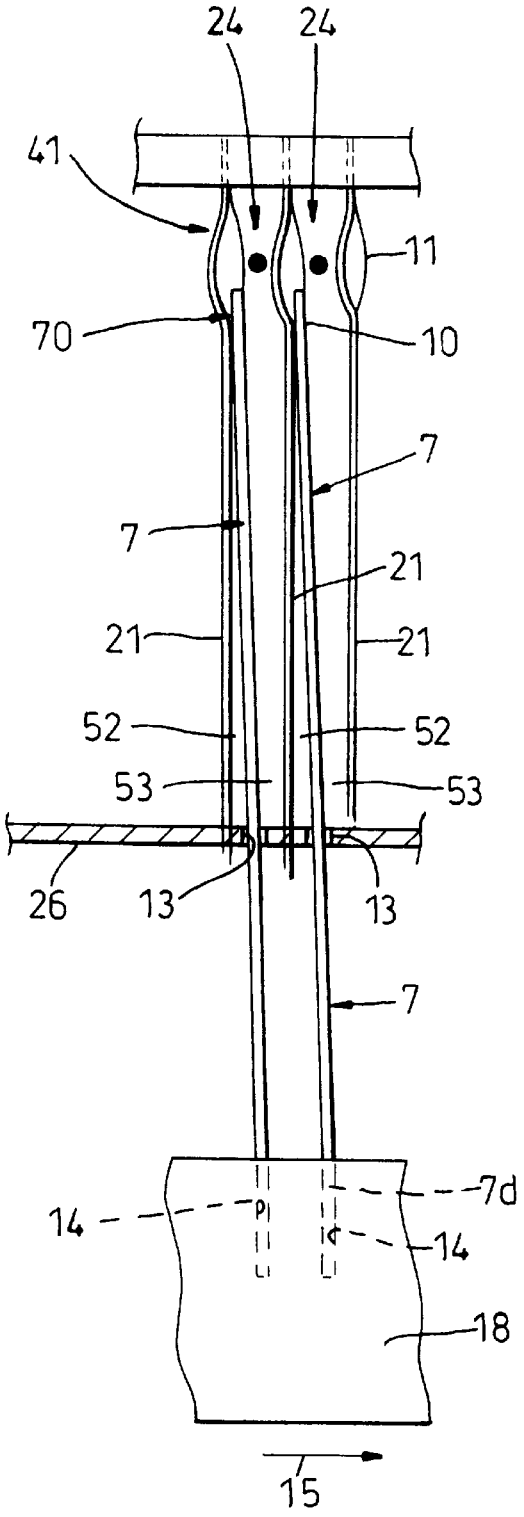
FIG. 2 is a part rear view of the embodiment of FIG. 1 shown at a first operating position.
Figure 3:
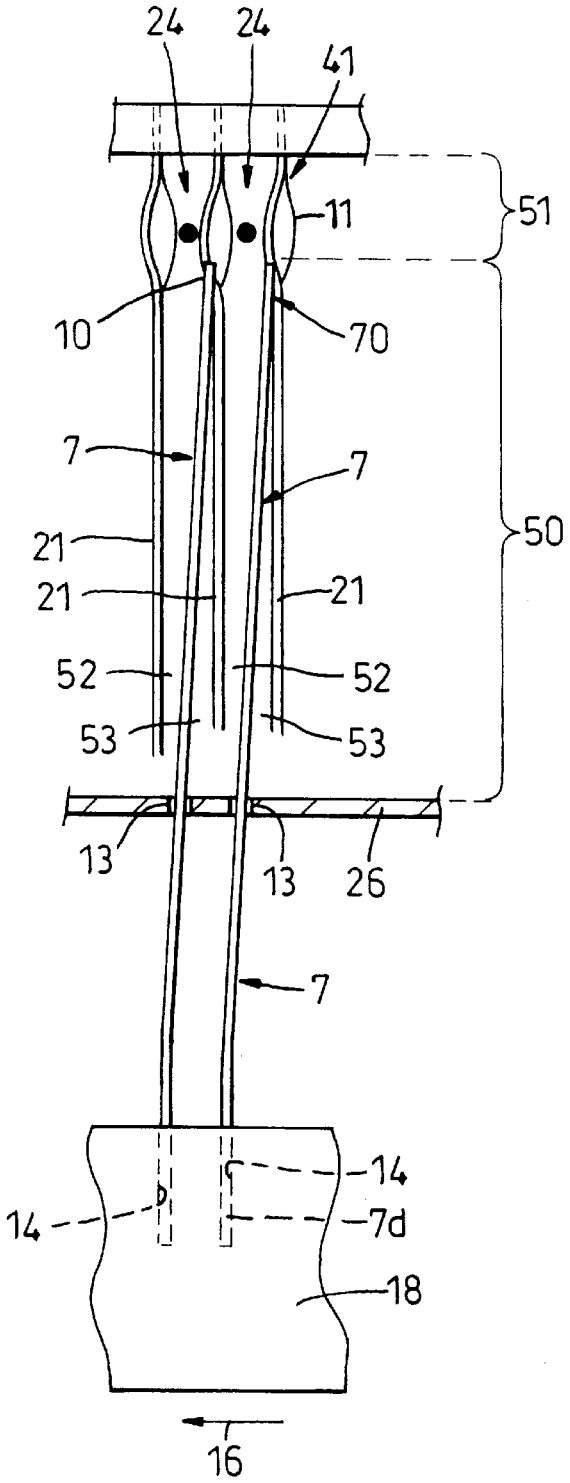
FIG. 3 is a similar view to FIG. 2 showing the embodiment at a second operating position.

The pile loop forming assembly 80 illustrated in FIGS. 1 to 3 includes a reed 20, having a plurality of reed fingers 21 spaced apart in the weft direction such that adjacent pairs of fingers 21 define a plurality of reed spaces 24.

Located within each reed space 24 is a loop forming lance 7, which as seen in FIG. 1 is generally planar and generally of U-shaped configuration Each lance 7 has a first portion 7*a* which extends forwardly from the reed 20 and a second portion 7*b* which extends rearwardly from the reed 20; the juncture between the first and second portions defining an upper region 70.

The first portion 7*a* extends to and beyond the fell F such that the terminal end region 7*c* of the first portion 7*a* is held within formed loops 5.

The terminal end 7*d* of the second portion 7*b* of each lance 7 is located in a moving elongate support preferably in the form of a reciprocating bar 18 such that as the bar 18 reciprocates, end 7*d* moves in unison with the bar 18. Preferably each terminal end 7*d* is preferably connected to the bar 18 by being located in a slot 14 formed in bar 18.

The bar 18 is oscillated either through levers from the loom shedding system or by an independent drive.

Located between the bar 18 and the reed 20 in an elongate support, preferably in the form of a bar 26, having a plurality of slots 13 formed therein spaced along its length.

At a position spaced inwardly from terminal end 7*d*, each lance 7 is pivotably connected to the bar 26 by being located in a slot 13 formed in the statically mounted bar 26.

The rearwardly extending piston 7*d* is sufficiently stiff in the weftwise direction so that the slot 13 acts as a fulcrum for the lance 7 about which it twists during reciprocation of the bar 18. Preferably as seen in FIGS. 2 and 3 each slot 13 (and hence each fulcrum) is arranged to be located generally centrally of the corresponding reed space 24.

Accordingly, as seen in FIGS. 2 and 3, as the bar 18 moves in the direction of arrow 15 the upper region of the lance 7 moves leftwards toward the reed finger defining the left-hand side of the reed space 24 and as the bar 18 moves in the direction of arrow 16 the upper region of the lance 7 moves rightwards toward the reed finger defining the right hand side of the reed space 24.

Bars 18 and 26 thereby co-operate to act upon each lance 7 to repeatedly deflect each lance laterally to a first lateral position (shown in FIG. 2) whereat the upper region 70 resides adjacent to the left hand reed finger and a second lateral position (shown in FIG. 3) whereat the upper region 70 resides adjacent to the right hand reed finger. Since each lance pivots about a corresponding slot 13 formed in bar 26 when it is deflected by bar 18, each lance tends to reside at an inclined angle relative to the reed fingers when at its first or second lateral positions.

As seen more clearly in FIGS. 2 and 3, the lance 7 in each reed space 24 extends upwardly from the lower end of the reed space and terminates at a position spaced from the upper end of the reed space.

The lance thereby divides the reed space 24 into a first longitudinal region 50 and a second longitudinal region 51.

In the first longitudinal region 50, the lance co-operates with the facing reed fingers to define first and second warp yarn accommodating spaces 52 and 53 respectively.

The warp yarns 2, 3 for forming the backing are retained at all times in the first longitudinal region 50 and are located within spaces 52, 53 as desired.

Heald 28 are provided for selectively moving a selected loop forming warp yarn to an upper position UP (yarn 8 in FIG. 1) out of the first longitudinal region 50. Accordingly, at its upper position in region 51, the selected loop yarn 8 is clear of the lance 7 and can be lowered back into region 50 to a lower position LP and in so doing be wrapped about the upper edge of lance portion 7*a* to thereby define a newly formed loop 5*a*.

The wrapping of loop forming yarn 6, 8 or 25 is achieved by deflecting the lance laterally such that when the selected loop forming yarn is moved from its upper position UP toward its lower position LP the lance resides at its first or second lateral position such that the selected loop forming yarn is guided into say space 52 if it has just been moved out of space 53 (or vice versa).

In order to assist guiding of the selected loop yarn into space 52 or 53, the reed fingers 21 are preferably provided with yarn guide formations 41 which act to deflect yarn inwardly of the reed space as it moves toward first region 50. In addition, the upper region 70 is preferably provided with a projection 10 which projects upwardly, preferably on the rearward side of the reed, to overlap the guide formations 41. This helps to reduce the risk of registry problems between the lance and reed fingers and thereby help ensure that the selected loop forming warp yarn is directed into the desired space 52, 53.

Preferably the reed fingers 21 are formed from steel strip and are preferably provided with a twist 11 to define guide formations 41.

Each lance 7 may be formed entirely in the piece from a resilient steel strip as shown in FIG. 1.

Figure 5:
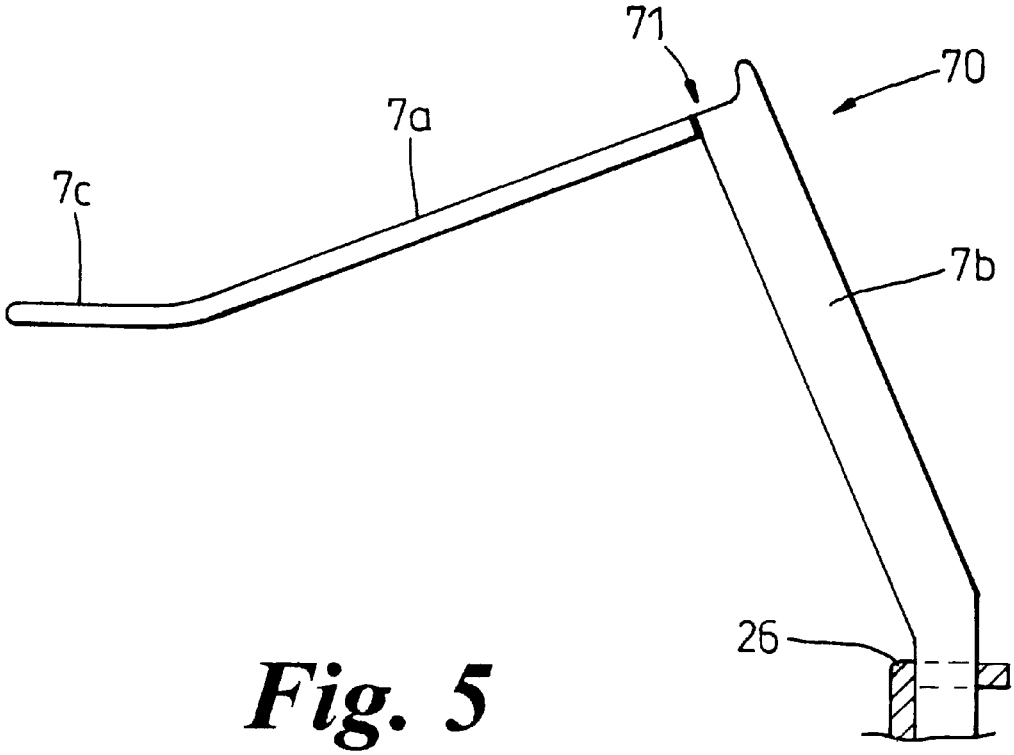
FIG. 5 is a part side view of an alternative construction of a lance.

Alternatively, as illustrated in FIG. 5, each lance 7 may be fabricated from a resilient steel wire and a resilient steel strip. In this respect, portions 7*a* and 7*c* are preferably formed from a steel wire and the rearwardly extending region 7*b* is formed from steel strip. The wire forming portion 7*a* is secured at a joint 71 for example by brazing or welding to the upper region 70 of portion 7*b*.

Forming portions 7*a*, 7*c* from a wire instead of a strip material is advantageous as the wire provides a smooth surface for the loop yarn to slide along during loop formation and, in addition, enables the portions 7*a*, 7*c* to be easily shaped longitudinally by bending to define a desired curve.

As shown in FIG. 1, the reed acts as a beat-up reed and moves between a weft-insertion position (shown in solid lines in FIG. 1) and a beat-up position (shown in broken lines in FIG. 1). As the reed moves toward its beat-up position, it engages the newly formed pile loop 5*a* on the lance portion 7*a* and pushes it to the fell F.

It is however envisaged that the reed for co-operating with the lances 7 to form pile loops 5 could be static and located to the rear of the beat-up reed.

It will be appreciated that as weaving progresses, previously formed loops 5 move along the terminal end portion 7*c* of each lance and are eventually pressed off.

Figure 4:
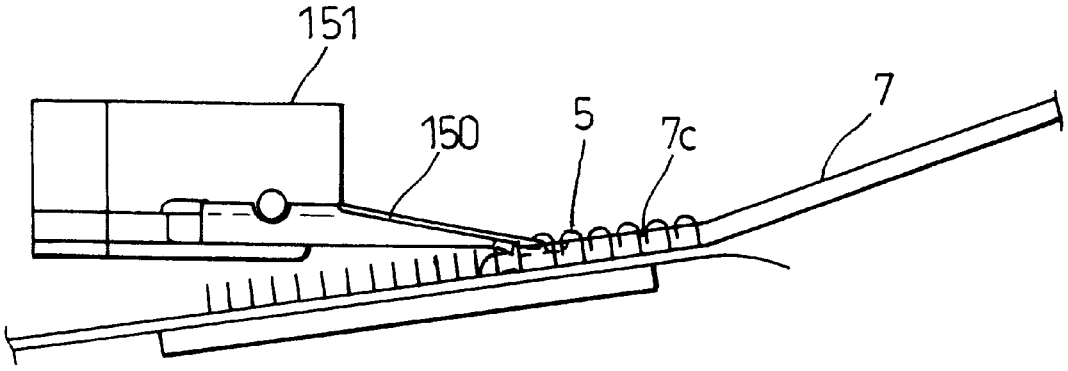
FIG. 4 is a part side view of the embodiment shown in FIG. 1 with the addition of a loop severing device.

If a cut pile is required, it is envisaged that the loops 5 may be cut as they move along terminal end portion 7*c*. For example as seen in FIG. 4, for each lance 7, a stationary blade 150 may be fastened to a mounting block 151 with the end of the blade 150 located in a groove formed in the lance with the blade edge opposing the forward direction of movement of the loops 5. Thus as the loops 5 advance they ride onto the blade edge and are severed.

The reed 20 is optionally made of reed fingers held in slots at the bottom end, and by bars 27 at the top.

In the case of a projectile loom, a slotted aperture 22 is formed in each finger 21 to guide the projectile across the shed.

In the case of a patterned carpet, the different colours of pile yarn 6, 8, 25 used are placed together in one reed space 24. When a particular colour yarn is not needed for the pile it is raised to an intermediate position 25 where it is buried during weaving in the carpet backing.

It will be appreciated that the number of pile forming yarns contained within each reed space may be more or less than 3 yarns.

What is claimed is:

1. A pile loop forming assembly for a loom comprising a reed having a plurality of reed fingers spaced apart to define reed spaces inbetween adjacent pairs of said reed fingers, a plurality of loop forming lances, each lance extending through a respective reed space in order to divide the reed space into first and second longitudinal regions and to divide the first longitudinal region into a first warp yarn accommodating space and a second warp yarn accommodating space, heald means for normally retaining a loop forming warp yarn in said first longitudinal region during shed formation, the heald means being operable to move the loop forming warp yarn from said first longitudinal region to the second longitudinal region so as to move said yarn out of said first or second warp yarn accommodating space, deflection means operatively connected to each lance for laterally deflecting the lance toward one or other of the reed fingers defining the reed space through which the lance passes, such that the lance resides at first and second lateral positions respectively, the lance when at said first lateral position co-operating with said one reed finger to deflect said loop forming yarn into said first warp yarn accommodating space when moving from said second longitudinal space and into said first longitudinal space and when at said second lateral position co-operating with said other reed finger to deflect said loop forming yarn into said second warp yarn accommodating space.

2. An assembly according to claim 1 wherein each lance is pivotably mounted so as to move about a fulcrum between said first and second lateral positions.

3. An assembly according to claim 2 wherein the fulcrum for each lance is arranged to be generally centrally located relative to the reed space through which the lance passes.

4. An assembly according to claim 1 wherein the deflection means comprises a moving elongate support which is mounted for longitudinal reciprocal movement and a static elongate support located between said moving elongate support and said reed, each lance being pivotally connected to the static support member, and each lance being connected to the moving support so that reciprocal movement of the movable support causes each lance to deflect about its pivotal connection.

5. An assembly according to claim 4 wherein each lance is received in a slot formed in the static support member to defame said pivotal connection.

6. An assembly according to claim 4 wherein the pivotal connection for each lance is arranged to be generally centrally located relative to the reed space through which the lance passes.

7. An assembly according to claim 4 wherein each lance has a forwardly extending portion which extends from the fell side of the reed and a rearwardly extending portion which extends from the rearward side of the reed to be received in said moving elongate support, said rearwardly extending portion also extending from the bottom of the reed space through which it passes toward, but being spaced from, the top of said reed space so as to defame said first and second longitudinal regions.

8. An assembly according to claim 4 wherein when each lance is located at one of either its first and second lateral position, an upper portion of the lance is located adjacent to one or other of the reed fingers defining the reed space through which the lance passes.

9. An assembly according to claim 4 wherein the reed fingers are provided with yarn guide formations located at a position above an upper portion of each lance, the guide formations serving to deflect a yarn inwardly of the reed space as the yarn is moved from the second longitudinal region to the first longitudinal region.

10. An assembly according to claim 9 wherein each of said upper portions is provided with a projection which projects upwardly on the rearward side of the reed to overlap said guide formations.

11. An assembly according to claim 1 wherein said reed constitutes as a beat-up reed.

12. An assembly according to claim 2 wherein, the assembly is attached to a loom.

* * * * *

UNITED STATES PATENT AND TRADEMARK OFFICE

CERTIFICATE OF CORRECTION

PATENT NO. : 6,234,212 B1
DATED : May 22, 2001
INVENTOR(S) : Griffith, John Dalton It is certified that error appears in the above-identified patent and that said Letters Patent is hereby corrected as shown below:

Column 5, claim 7,
Line 8, delete "defame" and insert -- define --.

Column 6, claim 12,
Line 12, insert -- adapted to be -- between the words "is" and "attached".

Signed and Sealed this

Fifth Day of March, 2002

*Attest:*

*Attesting Officer*

JAMES E. ROGAN
*Director of the United States Patent and Trademark Office*